US007475779B2

(12) United States Patent
Kellar et al.

(10) Patent No.: US 7,475,779 B2
(45) Date of Patent: Jan. 13, 2009

(54) PACKAGING

(75) Inventors: David S. Kellar, Corvallis, OR (US); Jeremy B. Crystal, Corvallis, OR (US); Timothy J. Hopfer, Albany, OR (US); Peter M. Matthews, New York, NY (US); George N. Hackleman, Adair Village, OR (US); Deirdre M. Sharkey, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 508 days.

(21) Appl. No.: 11/078,100

(22) Filed: Mar. 11, 2005

(65) Prior Publication Data

US 2006/0201843 A1 Sep. 14, 2006

(51) Int. Cl.
*B65D 73/00* (2006.01)

(52) U.S. Cl. ..... 206/469; 206/462; 206/471

(58) Field of Classification Search ..... 206/461, 206/462, 469, 471, 495, 439
See application file for complete search history.

(56) References Cited

U.S. PATENT DOCUMENTS

| | | | | | |
|---|---|---|---|---|---|
| 1,746,006 | A | * | 2/1930 | Metzger | 229/234 |
| 1,784,937 | A | | 12/1930 | Kreslawsky | |
| 2,993,590 | A | * | 7/1961 | Denton | 206/469 |
| 3,127,010 | A | * | 3/1964 | Capezzuto | 206/45.2 |
| 3,303,930 | A | * | 2/1967 | Hyland | 206/462 |
| 3,556,388 | A | * | 1/1971 | Klein | 229/247 |
| 3,658,175 | A | | 4/1972 | Vrana | |
| 4,062,449 | A | | 12/1977 | Popkes et al. | |
| 4,702,368 | A | * | 10/1987 | Jones | 206/45.24 |
| 4,804,984 | A | | 2/1989 | Heuer et al. | |
| 5,074,418 | A | | 12/1991 | Buan et al. | |
| 5,131,539 | A | * | 7/1992 | Karita et al. | 206/462 |
| 5,323,896 | A | | 6/1994 | Jones | |
| 5,460,267 | A | | 10/1995 | Schiffer | |
| 5,497,882 | A | | 3/1996 | Kenyon | |
| 5,499,711 | A | | 3/1996 | Kozak | |
| 5,649,624 | A | | 7/1997 | Seaton | |
| 5,842,632 | A | | 12/1998 | Van Hest | |
| 6,059,106 | A | | 5/2000 | Baker et al. | |
| 6,123,421 | A | | 9/2000 | Bartolome et al. | |
| D463,978 | S | * | 10/2002 | DiMartino | D9/415 |
| 6,502,701 | B2 | * | 1/2003 | Shinada | 206/723 |
| 6,540,073 | B1 | | 4/2003 | Hagel et al. | |
| 6,669,020 | B1 | | 12/2003 | Mamiye | |
| D516,419 | S | * | 3/2006 | Kellar et al. | D9/415 |
| D520,356 | S | * | 5/2006 | Kellar et al. | D9/415 |

FOREIGN PATENT DOCUMENTS

| | | |
|---|---|---|
| DE | 4124462 A1 | 10/1992 |
| EP | 0439728 B1 | 8/1991 |
| JP | 2001-199473 | 7/2001 |
| JP | 2004-026297 | 1/2004 |

OTHER PUBLICATIONS

International Search Report for Application No. PCT/2006/008712. Report issued Jul. 13, 2006.

* cited by examiner

*Primary Examiner*—J. Gregory Pickett

(57) ABSTRACT

Various embodiments of product packaging including a blister are disclosed. In one embodiment, the packaging has a tear-away portion. In one embodiment, the packaging includes a gas permeable lid. In yet another embodiment, the blister is configured to retain differently sized ink cartridges.

42 Claims, 7 Drawing Sheets

PACKAGING

BACKGROUND

Blister packaging is sometimes used to both ship and display a product. In many instances, a customized blister must be provided for each distinct product. During high altitude shipping, blister packages are sometimes damaged or broken. Once the product and its blister packaging is sold, the packaging is sometimes re-used to contain counterfeit products.

DETAILED DESCRIPTION OF EXAMPLE EMBODIMENTS

Figure 1:
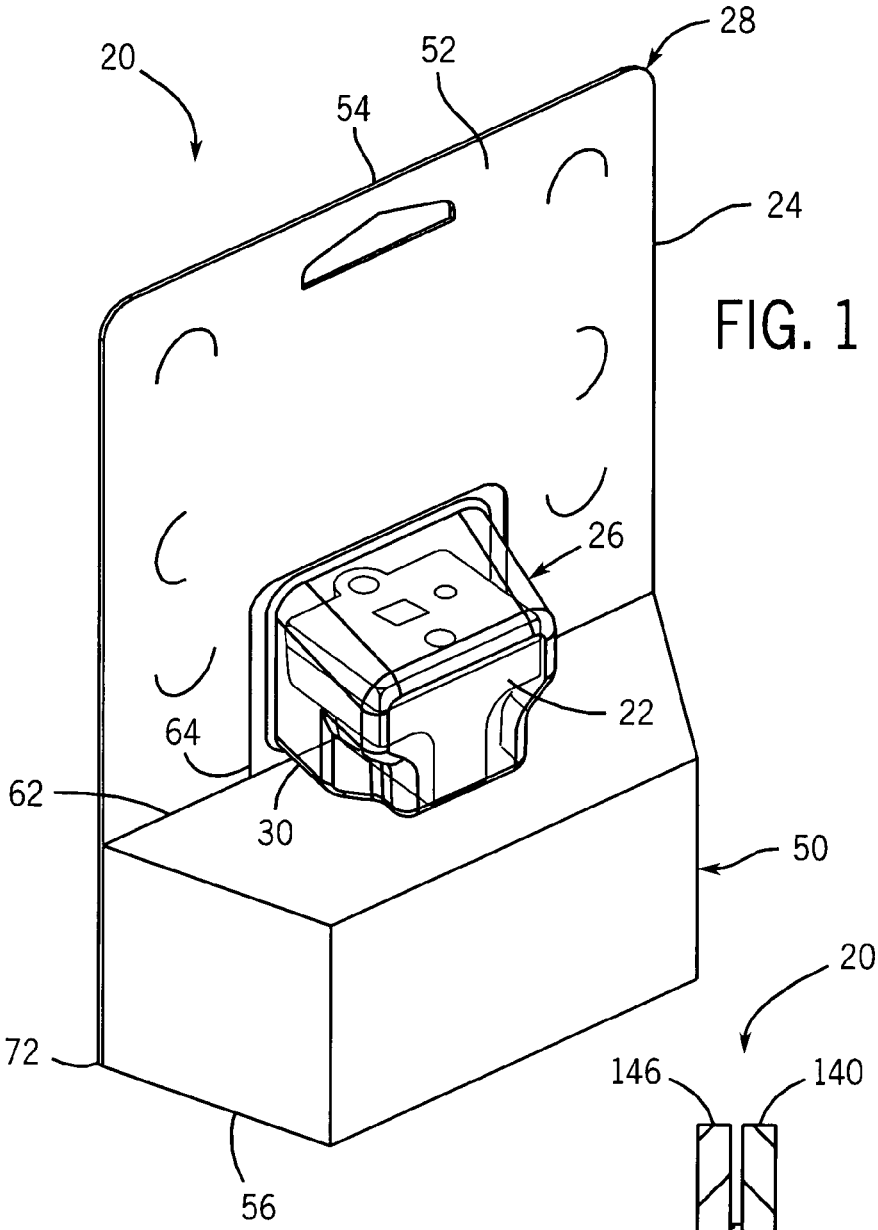
FIG. 1 is a perspective view of a product packaging system according to one exemplary embodiment.
Figure 2:
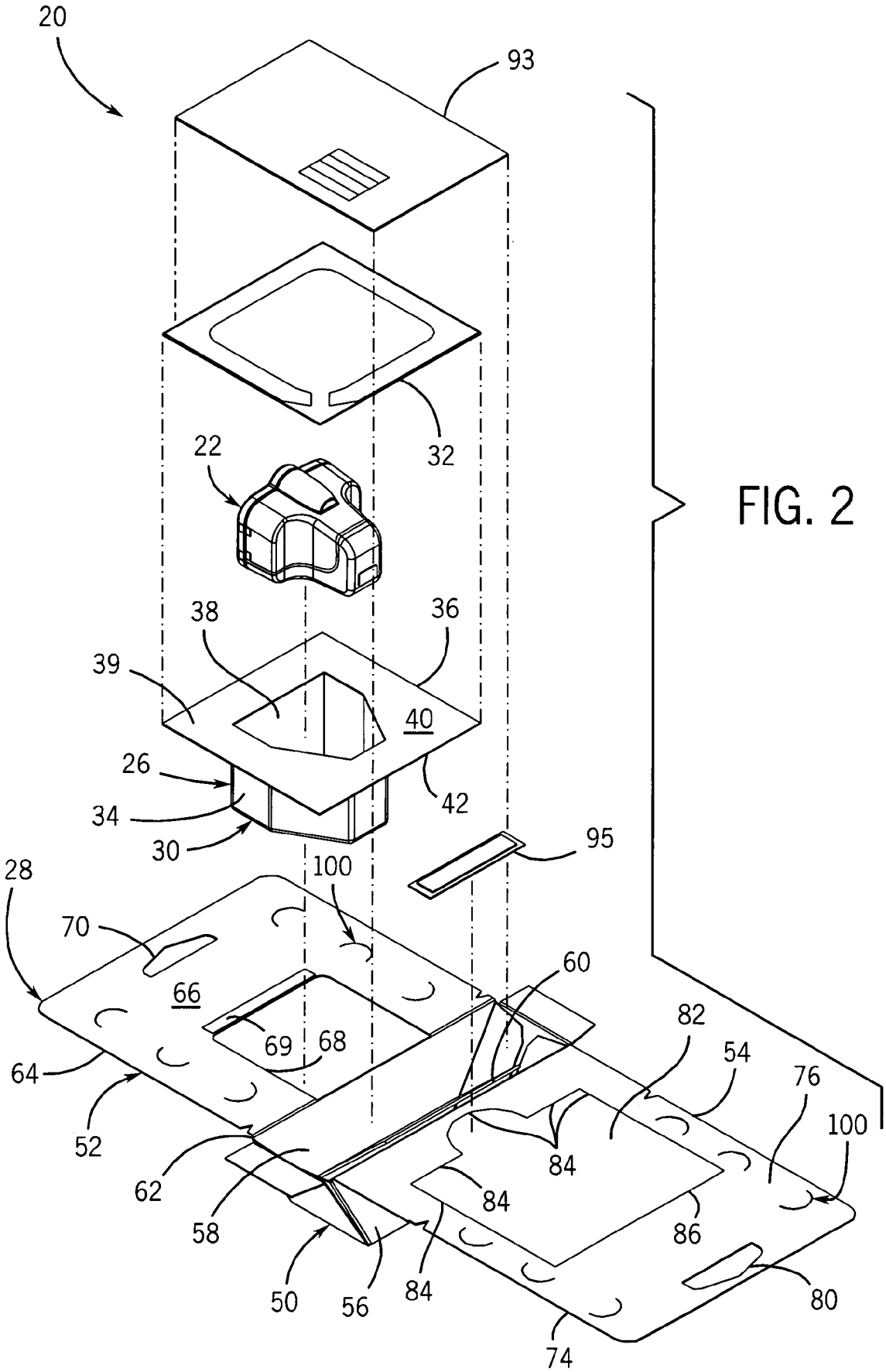
FIG. 2 is an exploded perspective view of the system of FIG. 1 according to one exemplary embodiment.

FIGS. 1 and 2 illustrate one example embodiment of a product packaging system 20 which generally includes product 22 and its packaging 24. In the particular example shown, product 22 comprises an inkjet cartridge configured to supply an ink or other fluid to a printer or other image-forming apparatus (not shown). In one embodiment, product 22 may comprise an ink cartridge which additionally includes a printhead. In other embodiments, product 22 may comprise an ink cartridge without such a printhead. Although product 22 is illustrated as comprising an ink cartridge that is generally T-shaped, product 22 may comprise an ink cartridge having other shapes. In still other embodiments, product 22 may comprise other articles.

Packaging 24 surrounds and contains product 22. In one embodiment, packaging 24 is generally configured to sufficiently stabilize product 22 to reduce damage to product 22 during shipping. In one embodiment, packaging 24 is additionally configured to facilitate the display and retail sale of product 22. Packaging 24 generally includes blister assembly 26 and support 28. Blister assembly 26 contains product 22 and generally includes blister 30 and lid 32 (shown in FIG. 2). Blister 30 generally comprises a thin film of polymeric material that has been formed to provide a product receiving portion 34 and a mounting portion 36. Product receiving portion 34 forms an interior cavity 38 into which product 22 is received. Mounting portion 36 projects from product receiving portion 34 and is configured to facilitate mounting of blister 30 to lid 32 and to support 28. In the embodiment shown, mounting portion 36 includes an outwardly projecting generally flat or planar extension or flange 39 having opposite faces 40 and 42 which provide surfaces against which lid 32 and support 28 may abut.

In one particular embodiment, blister 30 is formed from a transparent polymeric film so as to enable product 22 to be seen within packaging 24. The polymeric material has a sufficient rigidity or strength so as to generally maintain its shape absent external forces and so as to retain the positioning of product 22 within cavity 38. In one particular embodiment, blister is formed from 26 mil recycled polyethyleneteraphalate (PET) such as TH E 770/60 recycled grade APET commercially available from Klockner. In other embodiments, blister 30 may be formed from other transparent or at least partially translucent materials such as clear polyvinyl chloride (PVC), polylactide (PLA) or oriented polystyrene (PS). In still other embodiments, blister 30 may be formed from opaque polymeric films and may have alternative thicknesses.

Lid 32 is a structure configured to close cavity 38 with product 22 within cavity 38. In one embodiment, lid 32 comprises a panel which spans cavity 38 and is adhered to face 40 of mounting portion 36. Lid 32 cooperates with blister 30 to contain product 22 as a unit independent of support 28. In other embodiments, lid 32 may be omitted, wherein support 28 closes product 22 within cavity 38 of blister 30.

Support 28 is coupled to blister assembly 26 and is configured to facilitate the hanging or the shelving of blister assembly 26 and product 22 in an upright orientation in which product receiving portion 34 projects from mounting portion 36 in a substantially horizontal direction. In the particular embodiment shown, support 28 enables blister assembly 26 to be both hung or shelved upon a horizontal surface in an upright orientation. In other embodiments, support 28 may have other configurations which facilitate either hanging of blister assembly 26 or the resting of blister assembly 26 on a horizontal surface in an upright orientation.

In the particular example shown, support 28 additionally provides an enlarged surface area for providing product literature (product name, specifications, advertising and other information) as well as providing an internal volume for containing additional product literature or other items.

In the particular example shown, support 28 includes compartment 50, front panel 52 and rear panel 54. Compartment 50 includes multiple walls which form a three-dimensional volume having a bottom surface 56 which is generally flat or planar and configured to support a remainder of system 20 in an upright orientation. In the particular example shown, compartment 50 forms an interior 58 in which additional items or literature, such as the return mail recycling envelope 60 may be stored. In other embodiments, interior 58 may be used to contain other literature, documentation or components. Compartment 50 generally extends beneath blister 30 and beneath product 22 and relative to the center of mass of system 20 so as to enable system 20 to rest upon a horizontal surface in an upright orientation without tipping over.

Front panel 52 projects from a top rear edge 62 of compartment 50 and includes front face 64, a rear face 66 and a central aperture 68. Front face 64 appears as the front back board for including text, graphics and other product information. Back face 66 is generally configured to abut face 42 of mounting portion 36 of blister 30 while being joined to rear panel 54. Central aperture 68 provides an opening through which product receiving portion 34 of blister 30 projects. Aperture 68 is generally shaped and sized smaller than mounting portion 36 of blister 30 but larger than product receiving portion 34 such that face 42 of mounting portion 36 abuts face 66 of panel 52. Although aperture 68 is illustrated as being generally rectangular, aperture 68 may have a variety of shapes and sizes.

In one particular embodiment, system 20 additionally includes an adhesive or glue 69 which is proximate to aperture 68 along face 66. Glue 69 is located so as to contact face 42 of mounting portion 36 to adhere blister 30 to panel 52. In other embodiments, adhesive or glue 69 may be omitted.

Rear panel 54 comprises a generally elongate planar panel of one or more materials projecting from a rear lower edge 72 of compartment 50. Rear panel 54 is generally configured to overlap a rear side of compartment 50 and to overlap face 66 of front panel 52. Rear panel 54 includes back face 74 and front face 76. Back face 74 generally contains text, images and other printing providing product information. Front face 76 is configured to abut lid 32, any portion of face 40 of mounting portion 36 that projects beyond lid 32 and back face 66 of front panel 52. Rear panel 54 extends to and abuts lid 32 (and the underlying face 40 of mounting portion 36 of blister 30) to capture mounting portion 36 against front panel 52. As will be described in greater detail hereafter, in one embodiment, rear panel 54 is bonded or adhered to front panel 52.

In the particular example shown, rear panel 54 includes hang hole 80 and access door 82. Hang hole 80 extends through rear panel 54 and cooperates with hang hole 70 of front panel 52. Hang holes 80 and 70 cooperate with one another to provide a hole through which a hanger tab, rod, post and the like may extend for hanging system 20 in an upright orientation. In other embodiments, hang hole 80 may be omitted where rear panel 54 is shortened or front panel 52 is lengthened such that those portions of front panel 52 forming hang hole 70 project beyond rear panel 54. In still other embodiments, hang hole 70 may be omitted where front panel 52 is shortened or where rear panel 54 is lengthened such that those portions of rear panel 54 forming hang hole 80 project beyond front panel 52. In still other embodiments, an additional structure forming a hang hole may be mounted to one or both of front panel 52 or rear panel 54.

Figure 3:
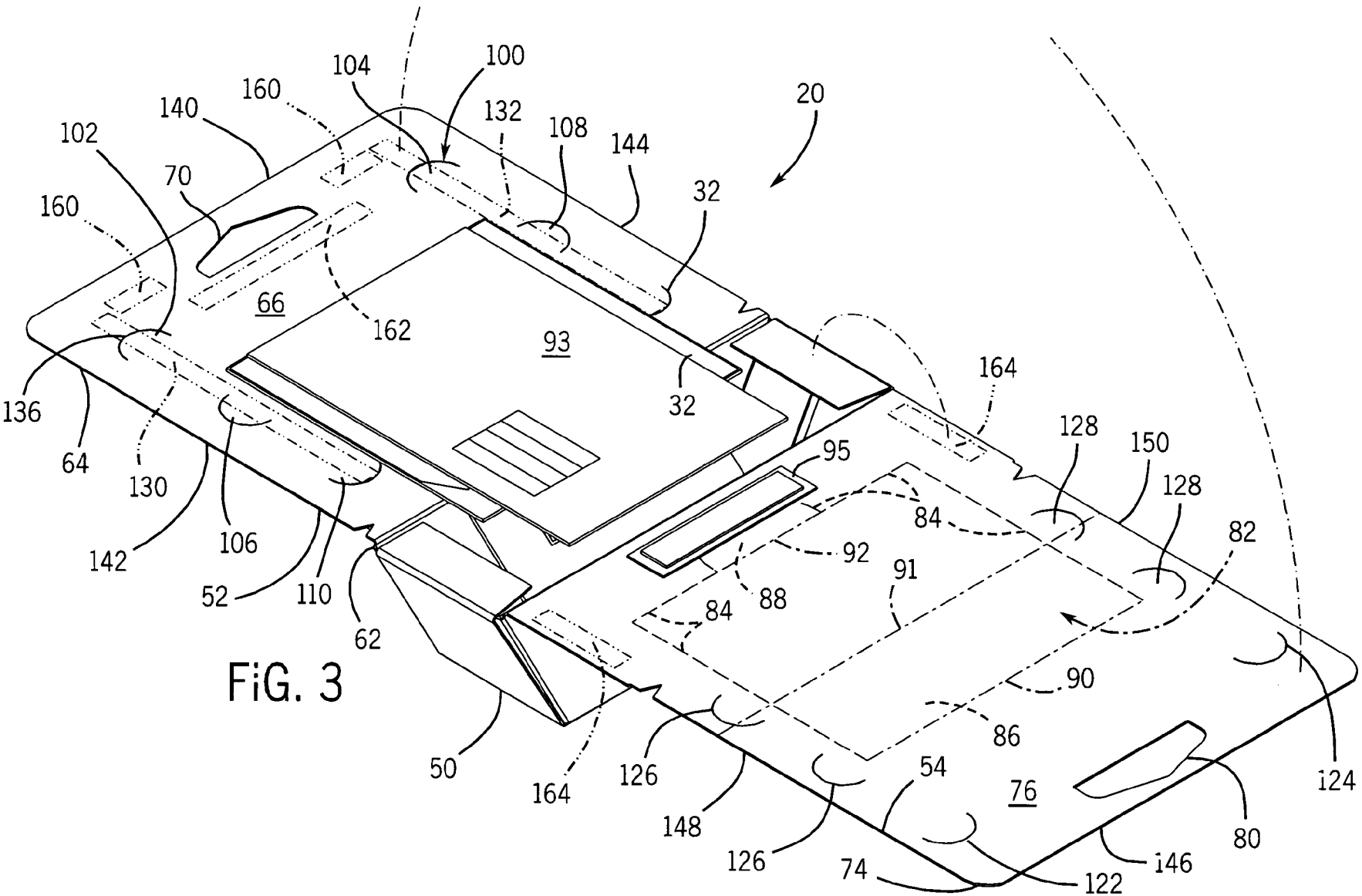
FIG. 3 is a perspective view of the system of FIG. 1 prior to assembly completion according to one exemplary embodiment.

As shown by FIG. 3, access door 82 comprises a portion of rear panel 54 defined by lines 84 of spaced intermittent perforations which form main portion 86 and gripping tab 88 of door 82. Main portion 86 of door 82 is hinged to the remainder of rear panel 54 along hinge line 90, enabling door 82 to be pivoted to provide access to lid 32 between front panel 52 and rear panel 54. In the particular embodiment shown, main portion 86 further includes an intermediate fold or hinge line 91 to assist in the separation of door 82 from the remainder of rear panel 54. Door 82 is sized and located such that separation of door 82 from a remainder of rear panel 54 exposes a sufficient portion of lid 32 such that lid 32 may be separated from blister 30 and such that product 22 may be removed from receiving portion 34 of blister 30 through the opening formed by door 82 being opened. In other embodiments, hinge line 86 may also be perforated to facilitate complete removal of door 82. Gripping tab 88 projects from and is joined to main portion 86 along pre-folded hinge line 92. Hinge line 92 enables tab 88 to be pivoted relative to main portion 86 to allow a person to grasp tab 88 with his or her fingers and to pull and separate main portion 86 from rear panel 54 to open door 82. In lieu of perforations, lines 84 may alternatively be partially scored or otherwise weakened relative to adjacent portions of rear panel 54.

Once door 82 has been pivoted or otherwise separated from lid 32, lid 32 may be removed to gain access to product 22 for the removal of product 22 from blister 30. In the particular example shown, system 22 additionally includes product literature 93 (shown in FIG. 2) which is captured between front panel 52 and rear panel 54 and over lid 32. Separation of door 82 additionally facilitates the removal of literature 93 from packaging 24. As shown by FIG. 2, system 20 additionally includes Electronic Article Surveillance (EAS) tag 95 secured to face 76 of rear panel 54. In other embodiments, literature 93 and tag 95 may be omitted. In still other embodiments, lid 32 may be omitted such that rear panel 54 and door 82 extend over and close product 22 within cavity 38.

FIGS. 3-9 illustrate one example of a counterfeit deterrence arrangement 100 incorporated as part of system 20. Counterfeit deterrence arrangement 100 may reduce the likelihood of packaging 24 being reused to contain and sell a counterfeit product 22. In particular, counterfeit deterrence arrangement 100 incorporated as part of packaging 24 enhances the likelihood that packaging 24 will be visibly damaged or altered upon the removal of an original authorized product 22. Arrangement 100 generally includes break-away portions 102, 104, 106, 108, 110, 112, 122, 124, 126 and 128, and bonds 130, 132. Break-away portions 102, 104, 106, 108, 110 and 112 comprise portions of front panel 52 at least partially defined by weakened areas of front panel 52 and joined or otherwise secured to rear panel 54. In a similar fashion, break-away portions 122, 124, 126 and 128 comprise portions of rear panel 54 which are at least partially surrounded by weakened regions of rear panel 54 and joined to front panel 52. In the particular example shown, each of break-away portions 102-128 are partially surrounded by weakened regions or lines 136 that completely extend through either front panel 52 or rear panel 54. Lines 136 are generally arcuate in shape so as to form semi-circular peninsulas. In other embodiments, lines 136 may have other shapes so as to form peninsulas which serve as break-away portions 102-128. In the particular embodiment illustrated, lines 136 comprise slits that completely extend through either panel 52 or panel 54. In still other embodiments, break-away portions 102-128 may be partially surrounded by regions that have been weakened by other means such as intermittent and spaced perforations, or score lines that only partially extend through a thickness of a respective panel. In still other embodiments, break-away portions 102-128 may be completely surrounded by a weakened line or region.

Figure 5:
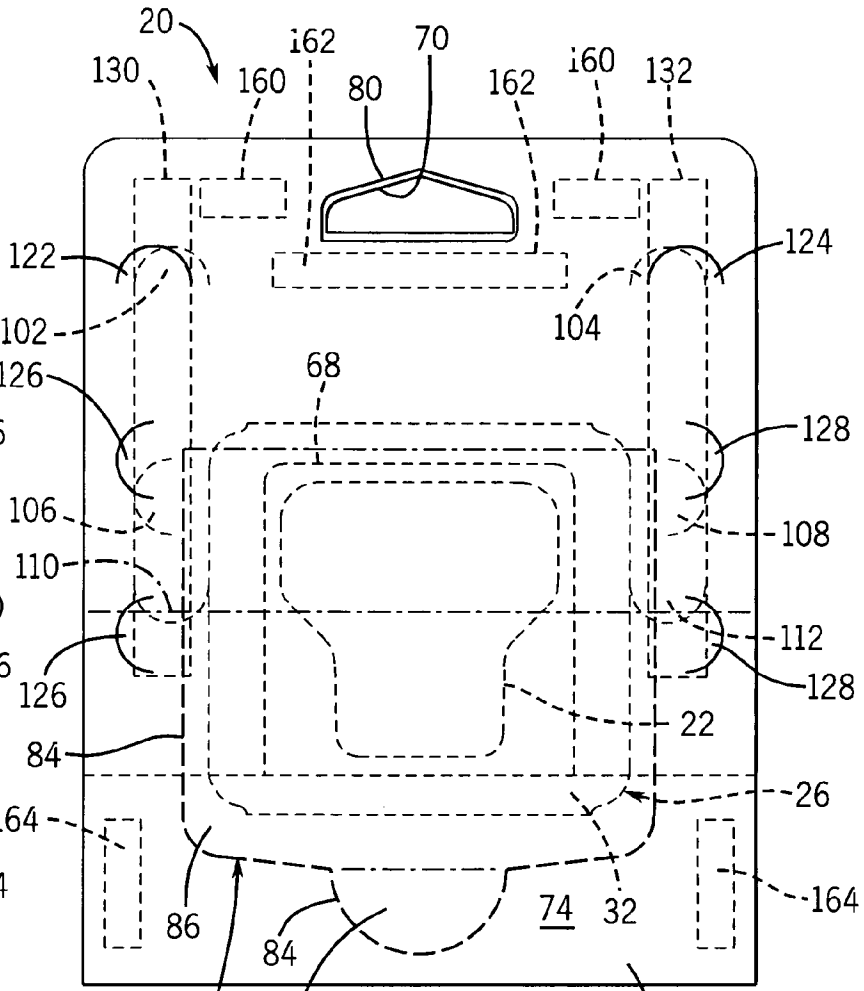
FIG. 5 is a rear plan view of the system of FIG. 1 according to one exemplary embodiment.
Figure 4:
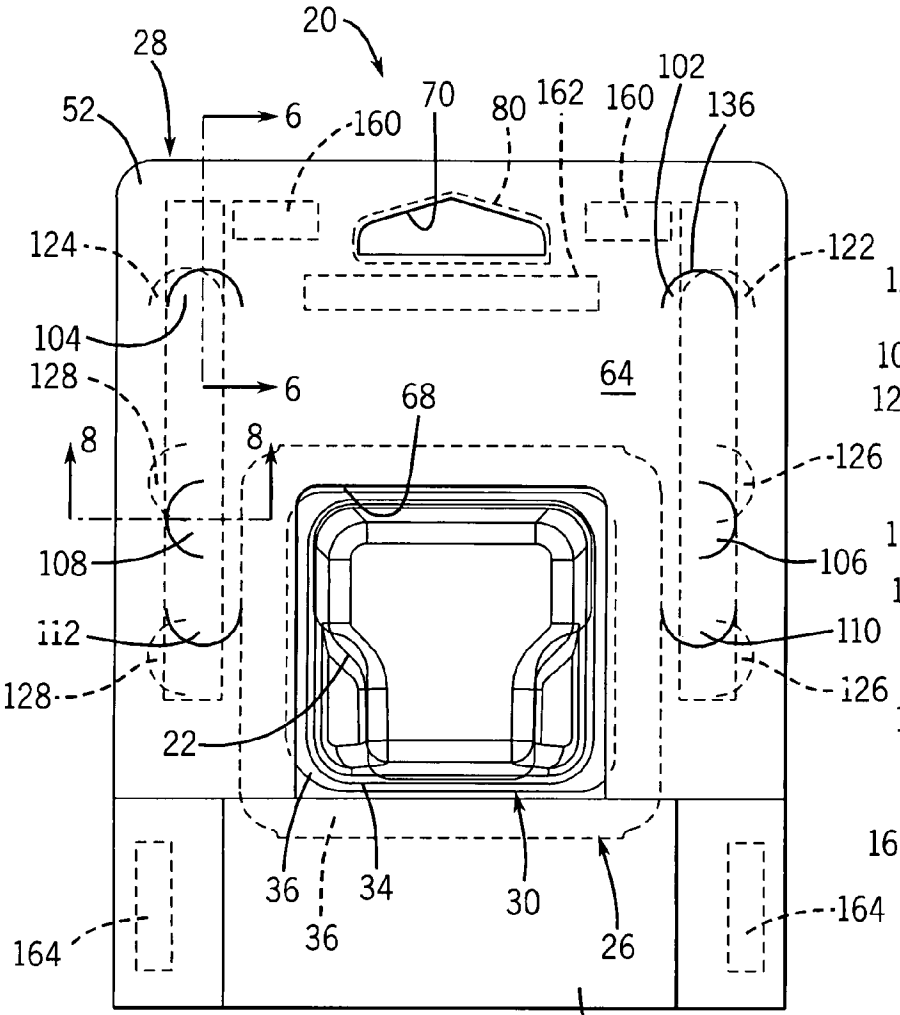
FIG. 4 is a front plan view of the system of FIG. 1 according to one exemplary embodiment.

In the embodiment shown, break-away portions 102-128 have different orientations relative to rear panel 52 and front panel 54. In the particular example shown, break-away portions 102 and 104 comprise peninsulas projecting towards edge 140 of front panel 52 on opposite sides of hang hole 70 and on opposite sides of blister 30. Break-away portions 106 and 108 comprise peninsulas projecting towards edges 142 and 144, respectively, on opposite sides of hang hole 70 and blister 30. Break-away portions 110 and 112 comprise peninsulas projecting towards edge 62 of front panel 52 on opposite sides of hang hole 70 and blister 30. Break-away portions 122 and 124 comprise peninsulas proximate to edge 146 and projecting towards edge 146 of rear panel 54 on opposite sides of hang hole 80 and door 82. Break-away portions 126 and 128 comprise pairs of peninsulas proximate to edges 148 and 150 and projecting towards edges 148 and 150, respectively, on opposite sides of hang hole 80 and door 82. As shown by FIGS. 4 and 5, break-away portions 102-112 of front panel 52 are offset with respect to break-away portions 122-128 of rear panel 54. As will be described in greater detail hereafter with respect to FIGS. 6-9, the multiple orientations and locations of break-away portions 102-128 and the offsetting of break-away portions 102-128 reduces the likelihood that rear panel 52 may be separated from rear panel 54 to gain access to product 22 without separating door 82 and without visibly damaging one or both of panels 52 and 54 regardless from which direction panels 52 and 54 are separated.

Bonds 130 and 132 generally comprise a glue, adhesive, melted polymeric material or other bonding material located upon each of break-away portions 102-128 and joining break-away portions 102-112 of front panel 52 to rear panel 54 and joining break-away portions 122-128 of rear panel 54 to front panel 52. In the particular example shown, bonds 130 and 132 comprise a glue material, such as HB Fuller Co. HL-9275, applied in a strip to face 66 of front panel 52 that extends across or within each of break-away portions 102-128 when panels 52 and 54 are joined to one another. As shown by FIG. 3, front panel 52 and rear panel 54 may be joined to one another and to portions of compartment 50 at other sites such as bonds 160,162 and 164.

In other embodiments, the bonding material used to form bonds 130 and 132 may comprise other glues or adhesives such as cold glue, superglue or fugitive glue. In lieu of being applied in a fluid form, the bonding material may alternatively be precoated upon face 66 or face 76 and later be activated, such as by the application of heat, to an adhesive state for joining panels 52 and 54. In other embodiments, in lieu of depositing the bonding material in the form of bonding strips 130, the bonding material may alternatively be applied intermittently across the entire face 66 or at focused locations on each of break-away portions 102-128. In lieu of bonds 130 and 132 comprising strips of bonding material initially formed on face 66 of front panel 52, bonds 130 and 132 may be formed by alternatively or additionally depositing bonding material on those break-away portions of rear panel 54.

Figure 6:
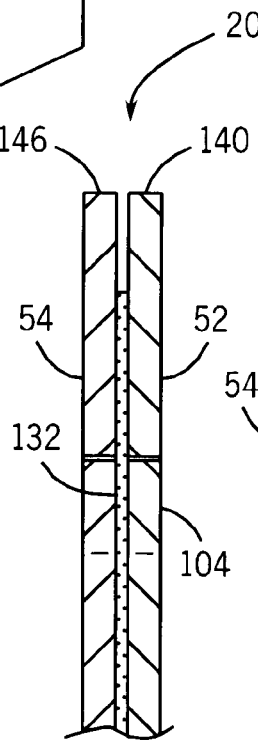
FIG. 6 is a sectional view of the system of FIG. 4 taken along lines 6-6 according to one exemplary embodiment.
Figure 7:
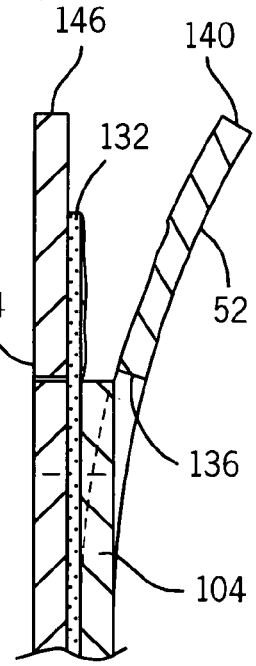
FIG. 7 illustrates the separation of edges of a front panel and a rear panel of the system of FIG. 6 according to one exemplary embodiment.

FIGS. 6-9 illustrate the operation of counterfeit deterrent arrangement 100. In particular, FIG. 6 illustrates break-away portion 104 of system 20 when panels 52 and 54 are joined together by bond 132. To gain access to product 22 (shown in FIG. 1), one would push in tab 88 of door 82 and open door 82 which would result in a visible alteration of packaging 24. However, in an attempt to reuse packaging 24 to contain a counterfeit product 22, a counterfeiter may attempt to separate panels 52 and 54 to gain access to the original product 22 without opening door 82 (shown in FIG. 3). As shown by FIG. 7, during the attempted separation of panels 52 and 54, break-away portion 104 remains joined to rear panel 54 while breaking away from front panel 52 along weakened region or line 136 of front panel 52. This results in front panel 52 being visibly altered to minimize the likelihood that packaging 24 may be reused to contain and resell a counterfeit product 22. Because break-away portion 104 is formed as a peninsula only partially surrounded by weakened areas or regions, continued separation of front panel 52 from rear panel 54 may result in additional tearing of front panel 52, further visibly altering front panel 52 to prevent or minimize packaging 24 from being reused with counterfeit products. In other embodiments, break-away portion 104 may be completely surrounded by a weakened region such that only break-away portion 104 is separated from front panel 52 to form an opening through front panel 52 and to visibly alter front panel 52.

Figure 8:
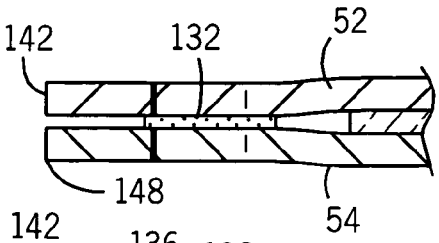
FIG. 8 is a sectional view of the system of FIG. 4 taken along line 8-8 according to one exemplary embodiment.
Figure 9:
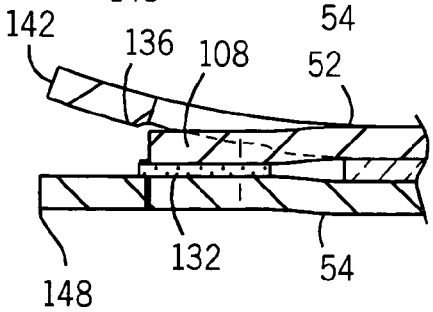
FIG. 9 illustrates separation of the edges of a front panel and a rear panel of the system of FIG. 8 according to one exemplary embodiment.

FIG. 8 is a sectional view of packaging 24 illustrating break-away portion 108 of front panel 52 joined to rear panel 54 by bond 132 while panels 52 and 54 are joined to one another. As shown by FIG. 9, when a counterfeiter attempts to separate panels 52 and 54 by peeling edges 142 and 148 away from one another, break-away portion 108 remains joined to rear panel 54 by bond 132 and is separated from front panel 52 to visibly alter front panel 52. Because break-away portion 108 is formed as a peninsula, additional separation of panels 52 and 54 may result in additional tearing of front panel 52 to further visibly alter front panel 52. Break-away portions 102, 106, 110, 112, 122, 124, 126 and 128 function similarly to break-away portions 104 and 108.

Figure 10:
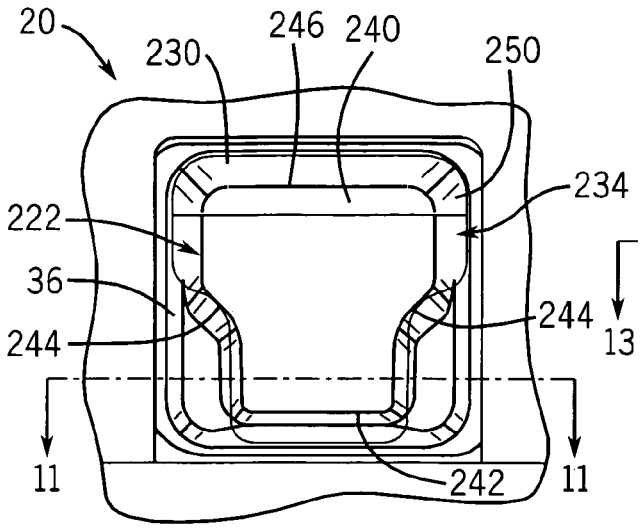
FIG. 10 is a fragmentary front elevational view of the system of FIG. 1 including another embodiment of a blister containing the product according to one exemplary embodiment.
Figure 12:
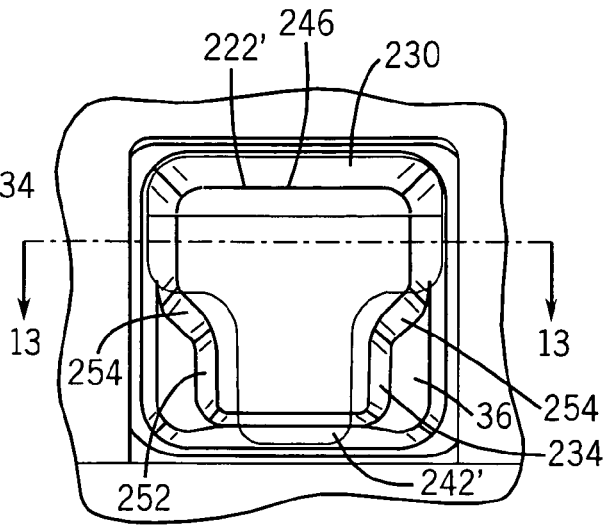
FIG. 12 illustrates the system of FIG. 10 with the blister containing another embodiment of a product according to one exemplary embodiment.
Figure 11:
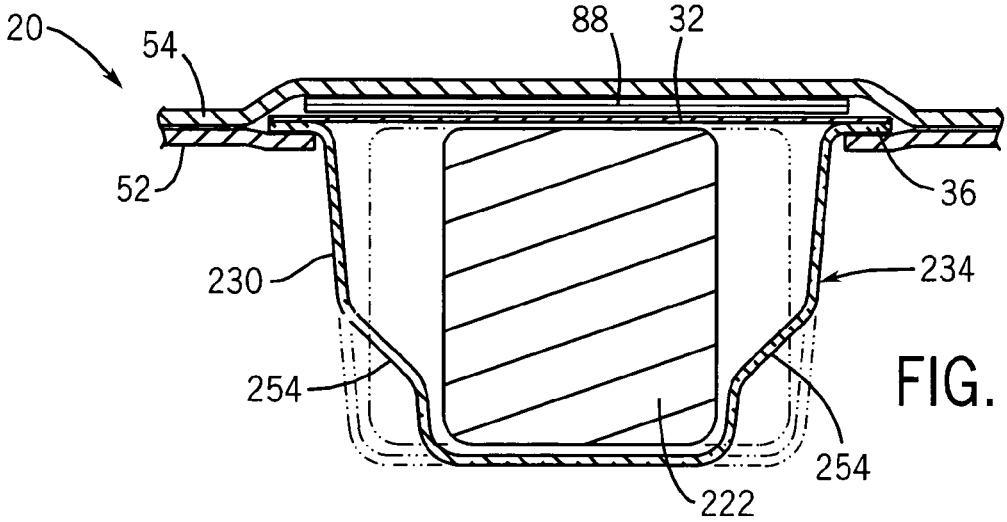
FIG. 11 is a sectional view of the system of FIG. 10 taken along line 11-11 according to one exemplary embodiment.
Figure 13:
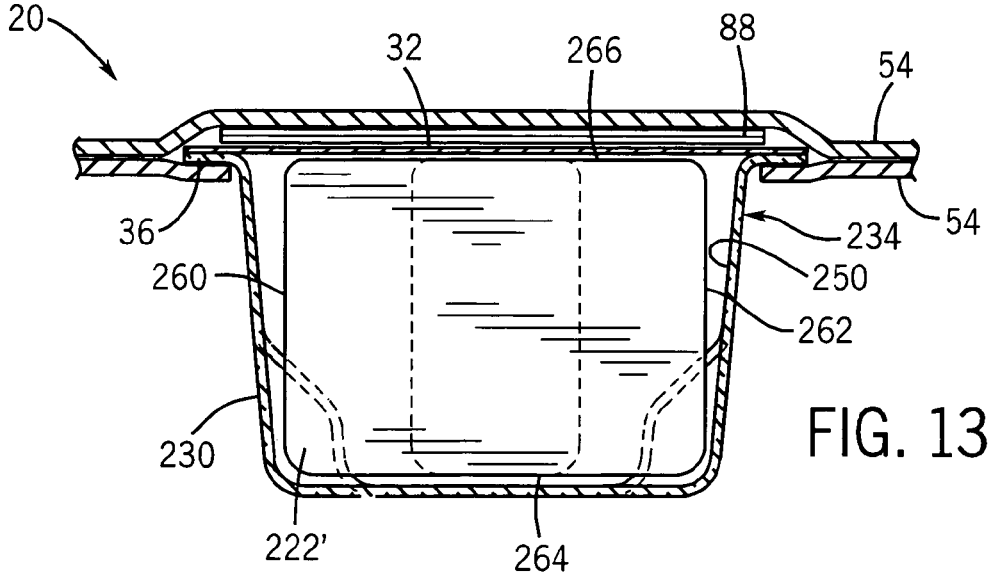
FIG. 13 is a sectional view of the system of FIG. 12 taken along line 13-13 according to one exemplary embodiment.

FIGS. 10-13 illustrate portions of packaging system 20 alternatively including blister 230 in lieu of blister 30 (shown in FIGS. 1-5). Blister 230 is configured to receive differently sized ink cartridges while ink receiving portion 234 engages opposite surfaces of each of the differently sized ink cartridges. In particular, FIGS. 10 and 11 illustrate product receiving portion 234 of blister 230 receiving ink cartridge 222. FIGS. 12 and 13 illustrate product receiving portion 234 of blister 230 receiving ink cartridge 222'. In the particular example illustrated in FIGS. 10 and 11, ink cartridge 222 has a generally T-shaped top profile and includes portions 240 and 242. Portion 240 is generally wider than portion 242. In the particular example shown, portion 240 includes a top face 246 through which ink within cartridge 222 is discharged.

As shown by FIGS. 12 and 13, ink cartridge 222' is similar to ink cartridge 222 except that ink cartridge 222' includes a portion 242' in lieu of portion 242. Portion 242' has a narrower width or transverse dimension (as seen in FIG. 12) as compared to portion 242. The generally wider lower portion 242 of ink cartridge 222 may enable ink cartridge 222 to contain a greater volume of ink as compared to ink cartridge 222' and its narrower portion 242'. Although cartridges 222 and 222' have different ink storage capacities, both cartridges 222 and 222' have a commonly configured upper portion 240 and a commonly configured face 246 through which ink is discharged.

As further shown by FIGS. 10 and 12, despite the different configurations of cartridges 222 and 222', product receiving portion 234 of blister 230 is configured to receive both cartridges 222 and 222'. In addition, product receiving portion 234 of blister 230 sufficiently engages both cartridges 222 and 222' to substantially inhibit movement of either cartridge 222 or 222' within receiving portion 234. In particular, product receiving portion 234 of blister 230 includes cavity portion 250, cavity portion 252 and shoulders 254. As shown by FIG. 13, cavity portion 250 is sized and dimensioned so as to receive portion 240 of either cartridge 222 or cartridge 222'. As further shown by FIG. 13, cavity portion 250 is configured such that product receiving portion 234 abuts or extends into close proximity to sides 260, 262 and 264 of portion 240 while holding side 266 of cartridge portion 240 into close proximity or against lid 32.

Shoulders 254 extend between portion 250 and portion 252 and are configured to abut shoulders 244 of cartridge 222 when cartridge 222 is within product receiving portion 234 or shoulders 244 of cartridge 222' when cartridge 222' is received by product receiving portion 234. Shoulders 254 provide inwardly converging opposite surfaces that engage the corresponding surfaces of differently sized but similarly configured ink cartridges 222 and 222'. As a result, shoulders 254 of product receiving portion 234 substantially capture portion 240 and retain cartridge 222 or cartridge 222' in place regardless of whether portion 252 is receiving portion 242 of cartridge 222 or portion 242' of cartridge 222'.

Figure 14:
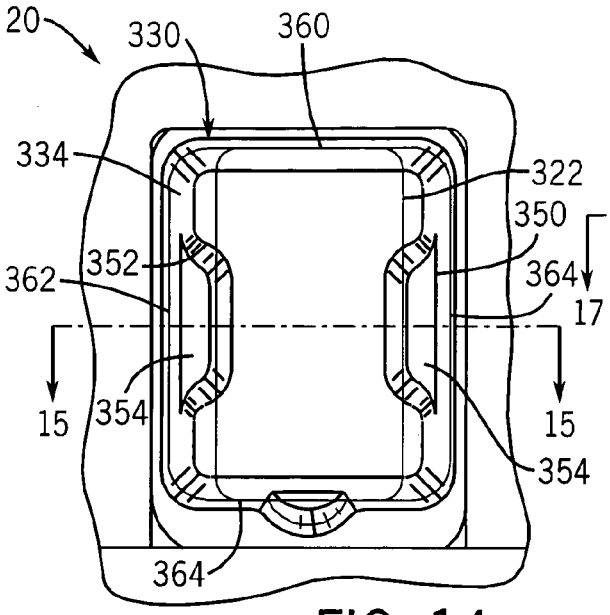
FIG. 14 is a fragmentary front elevational view of the system of FIG. 1 including another embodiment of a blister receiving another embodiment of a product according to one exemplary embodiment.
Figure 16:
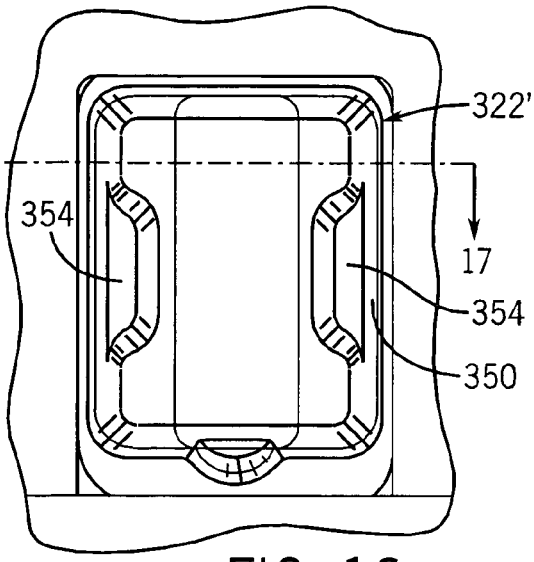
FIG. 16 illustrates the system of FIG. 14 with the blister receiving another embodiment of a product according to one exemplary embodiment.
Figure 15:
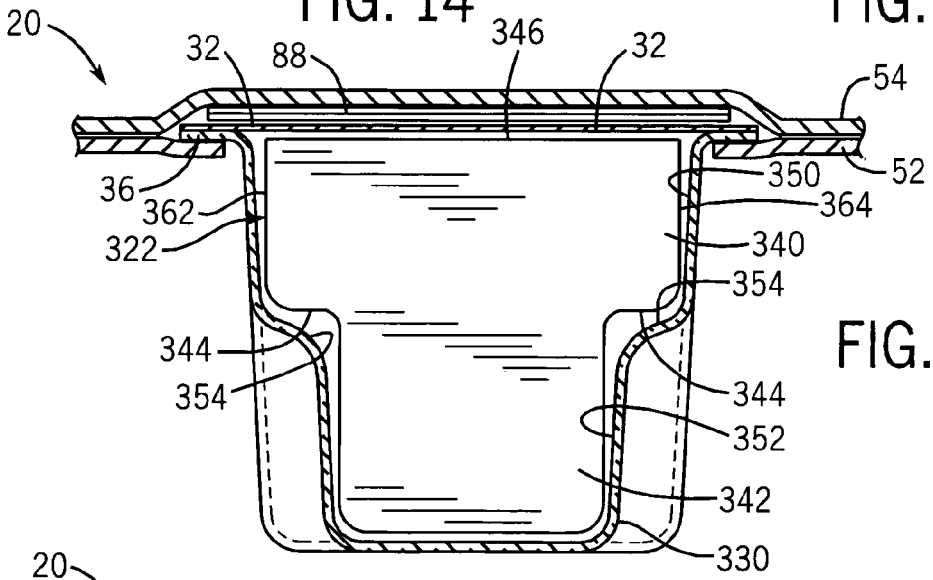
FIG. 15 is a sectional view of the system of FIG. 14 taken along line 15-15 according to one exemplary embodiment.
Figure 17:
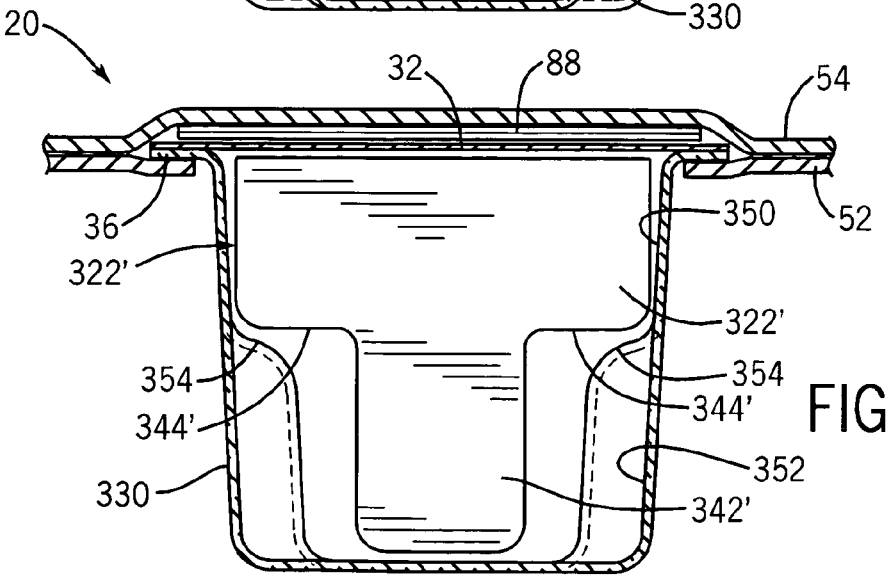
FIG. 17 is a sectional view of the system of FIG. 16 taken along line 17-17 according to one exemplary embodiment.

FIGS. 14-17 illustrate packaging system 20 alternatively including blister 330 in lieu of blister 30. Blister 330 is similar to blister 30 except that blister 330 includes product receiving portion 334 in lieu of product receiving portion 34. Product receiving portion 334 is configured to receive differently sized ink cartridges 322 and 322' while engaging or extending in close proximity with the corresponding surfaces of cartridge 322 or 322' to retain cartridge 322 or cartridge 322' against substantial movement within receiving portion 334. As shown by FIGS. 15 and 17, ink cartridges 322 and 322' each have a general T-shaped cross section. Ink cartridge 322 has portion 340, portion 342 and intermediate shoulders 344. Ink cartridge 322 has a face 346 through which ink is discharged from cartridge 322.

As shown by FIG. 17, ink cartridge 322' is similarly configured to ink cartridge 322 except that ink cartridge 322' has a narrower (as seen in FIG. 17) portion 342' in lieu of portion 342 and has shoulders 344' which correspond to shoulders 344 but which are wider. In the particular example shown, the greater width of portion 342 of ink cartridge 322 as compared to portion 342' of ink cartridge 322' may enable ink cartridge 322 to store and contain a greater volume of ink.

As shown by FIGS. 14-17, product receiving portion 334 generally includes cavity portion 350, cavity portion 352 and intermediate shoulders 354. Cavity portion 350 is situated proximate to lid 32 while cavity portion 352 is distant lid 32. Cavity portion 350 is configured to receive upper portion 340 of either ink cartridge 322 or ink cartridge 322'. As shown by FIGS. 14 and 16, cavity portion 350 extends about and into engagement or close proximity to each of the sides 360, 362, 364 and 366 of upper portion 350 of either ink cartridge 322 or 322'. Shoulders 344 extend between portion 350 and portion 352 and provide inwardly converging surfaces configured to face and abut or extend into close proximity to shoulders 344 of ink cartridge 322 or shoulders 344' of ink cartridge 322'. Shoulders 354 capture face 346 against or into close proximity with lid 32 to further secure ink cartridge 322 or ink cartridge 322' against substantial movement within product receiving portion 334 regardless of whether product receiving portion 334 is receiving ink cartridge 322 or 322'. As shown by FIGS. 15 and 17, cavity portion 352 is large enough to receive either the wider portion 342 of ink cartridge 322 or the narrower portion 342' of ink cartridge 322'.

As shown by FIGS. 14 and 16, shoulders 354 of ink receiving portion 334 are formed at intermediate and opposite locations such that product receiving portion 334 has a I-shaped profile. In other embodiments, portion 342 or portion 342' may alternatively be flared so as to also have a I-shaped profile. In other embodiments, in lieu of extending at intermediate opposite portions of product receiving portion 334, shoulders 354 may alternatively extend along the entire opposite left and right sides of product receiving portion 334 (as seen in FIGS. 14 and 16) or may extend inwardly towards one another at positions vertically offset with respect to one another (as seen in FIGS. 14 and 16).

Overall, because blisters 230 and 330 each include opposite inwardly converging shoulders 254 and 354 that face corresponding portions of differently sized ink cartridges, product receiving portions 234 and 334 securely retain ink cartridges 222, 222' and ink cartridges 322, 322' against substantial movement while enabling other portions of ink cartridges 222, 222' and ink cartridges 322, 322' to be differently sized for providing different ink containing or storage capacities. Because product receiving portions 234 and 334 can receive differently sized ink cartridges while retaining the differently sized ink cartridges against substantial movement, fewer packaging configurations may be used to hold each of the differently sized cartridges, potentially lowering packaging costs.

Figure 18:
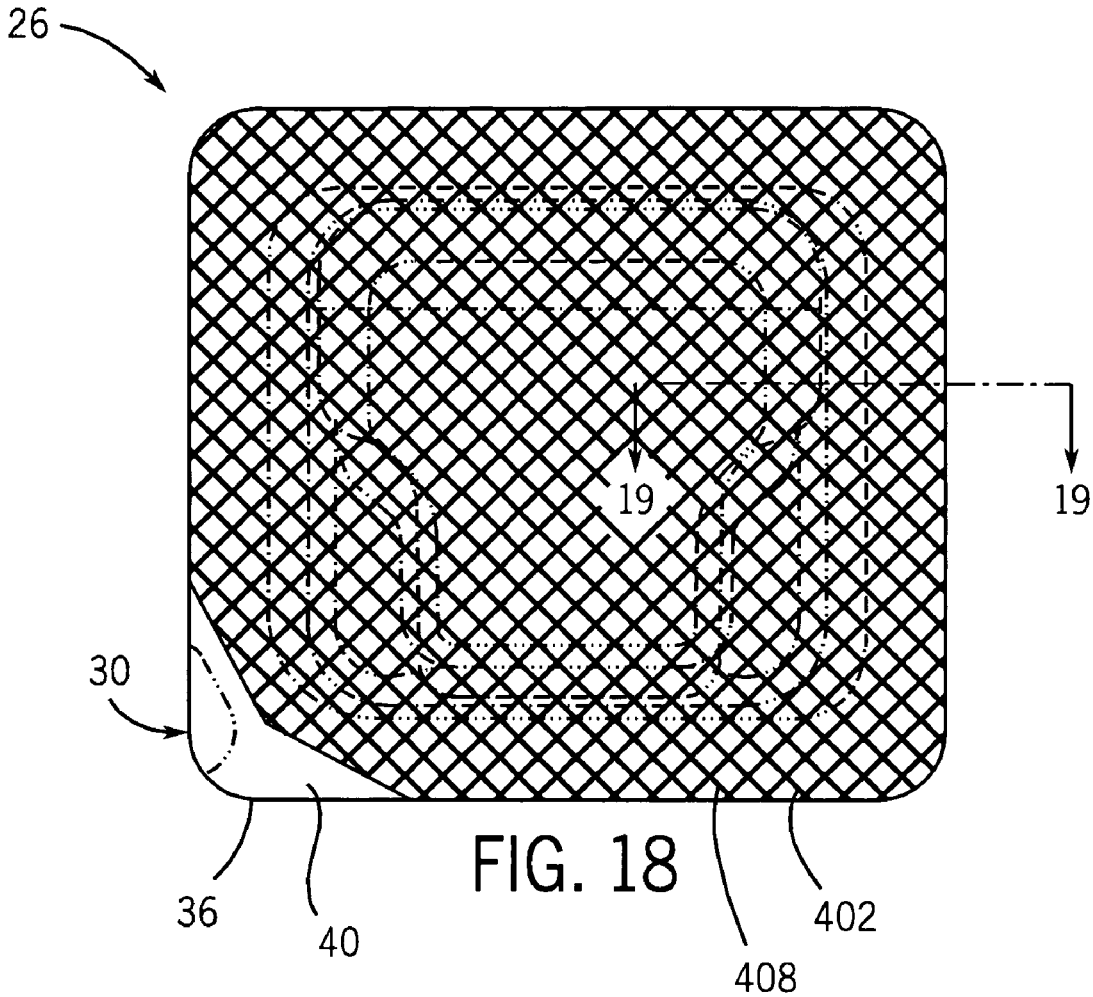
FIG. 18 is a top plan view of a blister assembly of the system of FIG. 1 according to one exemplary embodiment.
Figure 19:
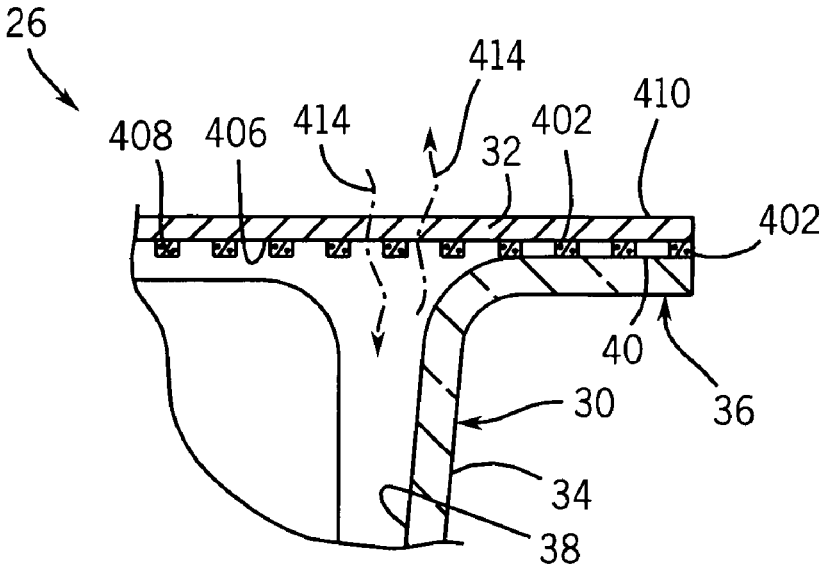
FIG. 19 is a sectional view of the blister assembly of FIG. 18 taken along line 19-19 according to one exemplary embodiment.

FIGS. 18 and 19 illustrate one example of lid 32 in greater detail. As shown by FIGS. 18 and 19, lid 32 is adhered to face 40 of mounting portion 36 of blister 30 by adhesive 402. As shown by FIG. 18, adhesive 402 extends across a lower face 406 of lid 32 at spaced locations. In the particular example shown in FIG. 18, adhesive 402 extends across face 406 in a matrix 408. Until activated, adhesive 402 is in a generally non-adhesive state. Once activated, such as by the application of heat, adhesive 402 attains an adhesive state so as to bond lid 32 to a mounting portion 36. In one particular embodiment, matrix 408 is formed as a checkerboard of stripes of adhesive 402. In one embodiment, lid 32 is joined to mounting portion 36 by positioning lid 32 and adhesive 402 over and across mounting portion 36 and heat activating adhesive 402 by applying heat to surface 410 of lid 32 opposite to mounting portion 36 to activate adhesive 402.

In the embodiment shown in FIGS. 18 and 19, lid 32 is formed from a gas permeable or porous material enabling cavity 38 of blister receiving portion 34 to "breathe". Because adhesive 402 is applied at spaced locations along surface 406, adhesive 402 may be blanket applied to surface 406 without completely sealing surface 406. As a result, as indicated by arrows 414, gas, such as air, may completely flow through lid 32 and through matrix 408 of adhesive 402 into and out of cavity 38. In one particular embodiment, lid 32 and adhesive 402 are sufficiently porous so as to allow sufficient air movement into and out of cavity 38 to accommodate pressure changes during shipment by commercial airline flights. In one embodiment, lid 32 and adhesive 402 are sufficiently porous to accommodate pressure changes during ascent of at least 500 feet per second without a substantial pressure change within cavity 38. In one embodiment, lid 32 and adhesive 402 comprise 70 g k64 paper/6 g SSL-198 Overall Grid Heat Seal Coating commercially available from Amcor part #PPG-018 located at 4101 Lien Road, Madison, Wis. 53704-3604. In other embodiments, lid 32 and adhesive 402 may be formed from other materials. In other embodiments, adhesive 402 may be selectively applied to surface 406 of lid 32 and those portions to be directly joined to mounting portion 36. In such alternative embodiments, adhesive 402 is selectively applied to surface 406 and may be configured so as to not require activation to achieve an adhesive state. In other embodiments, adhesive 402 may have a constant adhesive state but may be covered by a releasable sheet that may be separated from adhesive 402 at time of application.

As shown by FIGS. 4 and 5, front panel 52 and rear panel 54 are joined to one another by adhesive not completely surrounding lid 32. As a result, packaging 24 forms an air flow passage between panels 52 and 54 to lid 32. In the particular embodiment shown, panels 52 and 54 are each formed from a gas permeable or porous material such as paperboard. In one embodiment, panels 52 and 54 are formed from 0.018 CCLB paperboard having a density of 350 grams per meter squared. In other embodiments, panels 52 and 54 may be formed from other porous material. Although compartment 50 and panels 52, 54 are illustrated as being formed from a single integral unitary body or sheet, such as a single sheet of a single material, compartment 50, panel 52 and panel 54 may alternatively be formed from different materials and different sheets or structures that are otherwise joined to one another.

Because packaging system 20 provides a continuous gas flow package from an exterior of packaging 24 through panels 52, 54 or between panels 52, 54 to lid 32 and because lid 32 and its adhesive 402 are also gas permeable, the interior of cavity 38 may "breathe" to maintain the constant pressure within cavity 38 during shipment, such as during the ascent or descent in a commercial airline, lid 32 is less likely to encounter forces that would otherwise separate lid 32 from blister 30. As a result, the integrity of packaging 24 is maintained during shipment and product 22 is reliably contained within blister 30.

Although the foregoing has been described with reference to example embodiments, workers skilled in the art will recognize that changes may be made in form and detail without departing from the spirit and scope of thereof. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present subject matter described with reference to the example embodiments and set forth in the following claims is manifestly intended to be as broad as possible. For example, unless specifically otherwise noted, the claims reciting a single particular element also encompass a plurality of such particular elements.

What is claimed is:

1. A packaging comprising:

a blister including:

a product receiving portion; and a mounting portion having a first face and a second face;

a first panel along the first face;

a second panel along the second face, the second panel having a first break-away portion joined to the first panel so as to separate from the second panel when the first panel and the second panel are separated; and a gas permeable lid across the product receiving portion between the first face and the first panel, wherein the packaging forms a gas flow passage extending from an exterior of the first panel to the lid.

2. The packaging of claim 1, wherein the second panel includes a slit a least partially forming the first break-away portion.

3. The packaging of claim 2, wherein the first break-away portion is adhered to the first panel.

4. The packaging of claim 2, wherein the slit is arcuate.

5. The packaging of claim 2, wherein the slit includes a first portion on a first side of the break-away portion and a second portion on a second opposite side of the break-away portion.

6. The packaging of claim 1, wherein the second panel has a second break-away portion joined to the first panel so as to separate from the second panel when the first panel and the second panel are separated.

7. The packaging of claim 6, wherein the first break-away portion is on a first side of the blister and wherein the second break-away portion is on a second side of the blister.

8. The packaging of claim 6, wherein the first break-away portion and the second break-away portion are configured to separate from the second panel when the first panel and the second panel are separated from a common direction.

9. The packaging of claim 6, wherein the first break-away portion is configured to separate from the second panel when the first panel and the second panel are separated from a first direction and wherein the second break-away portion is configured to separate from the second panel when the first panel and the second panel are separated from a second distinct direction.

10. The packaging of claim 6, wherein the first break-away portion is a first peninsula extending in a first direction and wherein the second break-away portion is a second peninsula extending in a second distinct direction.

11. The packaging of claim 10, wherein the first direction and the second direction are opposite to one another.

12. The packaging of claim 6, wherein the second panel has a first edge and wherein the first break-away portion is proximate the first edge and comprises a first peninsula projecting towards the first edge.

13. The packaging of claim 12, wherein the second panel has a second opposite edge and wherein the second break-away portion comprises a second peninsula projecting towards the second edge.

14. The packaging of claim 13, wherein the second panel has a third edge extending between the first edge and the second edge and wherein the second panel includes a third break-away portion comprising a third peninsula projecting towards the third edge.

15. The packaging of claim 14, wherein the second panel has a fourth edge opposite the third edge and wherein the second panel includes a fourth break-away portion comprising a fourth peninsula projecting towards the fourth edge.

16. The packaging of claim 6, wherein the second panel includes a hole and wherein the first break-away portion is on a first side of the hole and wherein the second break-away portion is on a second side of the hole.

17. The packaging of claim 1, wherein the first panel has a second break-away portion having a first break-away portion face directly joined to an opposite second panel face of the second panel so as to separate from the first panel and so as to remain joined to the second panel when the first panel and the second panel are separated.

18. The packaging of claim 1, wherein the first panel includes a first total number of break-away portions joined to the second panel so as to separate from the first panel when the first panel and the second panel are separated, wherein the second panel includes a total number of break-away portions, including the first break-away portion, joined to the first panel so as to separate from the second panel when the first panel and the second panel are separated and wherein each break-away portion of the first total number of break-away portions is offset with respect to each break-away portion of the second total number of break-away portions.

19. The packaging of claim 1, wherein the second panel includes a door opposite the product receiving portion.

20. The packaging of claim 19, wherein the first break-away portion is on a first side of the door and wherein the second panel includes a second break-away portion on a second opposite side of the door, the second break-away portion joins to the first panel so as to separate from the second panel when the first panel and the second panel are separated.

21. The packaging of claim 1, wherein the first panel includes a door opposite the product receiving portion.

22. The packaging of claim 1, wherein the second panel is proximate the product receiving portion and wherein the first panel is distant the product receiving portion.

23. The packaging of claim 1 including a third panel extending non-parallel to the second panel opposite the product receiving portion of the blister.

24. The packaging of claim 23, wherein the third panel extends perpendicular to the second panel.

25. The packaging of claim 1 including a compartment on a side of the blister.

26. The packaging of claim 1, wherein the first panel extends outwardly beyond the lid.

27. The packaging of claim 1, wherein the product receiving portion of the blister is configured to receive differently sized ink cartridges while the blister engages opposite surfaces of each of the differently sized ink cartridges.

28. The packaging of claim 1, wherein the blister is configured to receive a first ink cartridge having a first cartridge portion with a first dimension and a second cartridge portion with a second dimension and, alternatively, a second ink cartridge having a third cartridge portion with a third dimension substantially equal to the first dimension and a fourth cartridge portion with a fourth dimension, wherein the blister engages opposite surfaces of the first cartridge portion when receiving the first ink cartridge and engages the opposite surfaces of the third cartridge portion when receiving the second ink cartridge.

29. The packaging of claim 1, wherein the product receiving portion of the blister includes a pair of opposite inwardly converging surfaces configured to engage a print cartridge received within the receiving portion.

30. The packaging of claim 1, wherein the product receiving portion has a T-shaped profile.

31. The packaging of claim 1, wherein the first panel and the second panel are integrally formed as a single unitary body.

32. An ink cartridge packaging system:

a blister including:

a product receiving portion; and a mounting portion having a first face and a second face;

an ink cartridge received within the product receiving portion;

a first panel along the first face;

a second panel along the second face, the second panel having a first break-away portion joined to the first panel so as to separate from the second panel when the first panel and the second panel are separated; and a gas permeable lid across the product receiving portion between the first face and the first panel, wherein the package forms a gas flow passage extending from the exterior of the first panel to the lid.

33. The system of claim 32, wherein the first panel extends outwardly beyond the lid.

34. The system of claim 32, wherein the ink cartridge has a first portion and a second portion and wherein the product receiving portion of the blister includes a first cavity portion receiving the first cartridge portion and a second cavity portion receiving the second cartridge portion, wherein the first cavity portion is larger than the first cartridge portion so as to be receptive of an alternative cartridge having a larger first portion and wherein the second cavity portion engages opposite surfaces of the second cartridge portion.

35. An ink cartridge packaging system comprising:

a blister having a cavity;

an ink cartridge received within the cavity;

a gas permeable lid closing the cavity; and a first panel extending across and outwardly beyond the lid while providing at least one gas passage to the lid.

36. The system of claim 35, wherein the first panel includes a hang hole.

37. The system of claim 35, wherein the hang hole extends on a first side of the blister and wherein the system additionally includes a compartment on a second opposite side of the blister.

38. The system of claim 37, wherein the compartment includes a bottom configured to rest upon a horizontal surface while supporting the system in an upright orientation.

39. An ink cartridge packaging system comprising:

a blister having a cavity;

an ink cartridge received within the cavity;

means for closing the cavity while permitting gas flow into the cavity; and means for hanging the system or resting the system upon a horizontal surface in an upright orientation with the blister facing in a horizontal direction.

40. The packaging of claim 1, wherein the first break-away portion of the second panel has a first break-away portion face opposite to a second panel face and directly bonded to the second panel face.

41. The packaging of claim 1, wherein the first break-away portion is joined to a first panel so as to remain joined to the first panel when the first panel and the second panel are separated by being peeled apart from one another.

42. The packaging of claim 1, wherein the first break-away portion is joined to a first panel such that separation of break-away portion from the second panel during separation of the first panel and the second panel forms an opening completely through the second panel where the first break-away portion existed prior to separation of the first panel and the second panel.

* * * * *

UNITED STATES PATENT AND TRADEMARK OFFICE

CERTIFICATE OF CORRECTION

PATENT NO. : 7,475,779 B2
APPLICATION NO. : 11/078100
DATED : January 13, 2009
INVENTOR(S) : David S. Kellar et al.

It is certified that error appears in the above-identified patent and that said Letters Patent is hereby corrected as shown below:

In column 9, line 56, in Claim 2, delete “a least” and insert -- at least --, therefor.

Signed and Sealed this

Fifth Day of May, 2009

JOHN DOLL
*Acting Director of the United States Patent and Trademark Office*